US007303440B2

(12) United States Patent
Stull et al.

(10) Patent No.: US 7,303,440 B2
(45) Date of Patent: Dec. 4, 2007

(54) UNIVERSAL BATTERY CHARGER/POWER SOURCE ADAPTER

(76) Inventors: Michael F. Stull, 2818 Honeysuckle Cir., Antioch, CA (US) 94531; James D. Tong, 3304 Terrace View Ave., Antioch, CA (US) 94531; Kody W. Kerwin, 2839 Honeysuckle Cir., Antioch, CA (US) 94531

( * ) Notice: Subject to any disclaimer, the term of this patent is extended or adjusted under 35 U.S.C. 154(b) by 0 days.

(21) Appl. No.: 11/536,864

(22) Filed: Sep. 29, 2006

(65) Prior Publication Data

US 2007/0077820 A1 Apr. 5, 2007

Related U.S. Application Data

(60) Provisional application No. 60/723,087, filed on Oct. 3, 2005.

(51) Int. Cl.
*H01R 13/66* (2006.01)

(52) U.S. Cl. ..... 439/620.04; 439/638

(58) Field of Classification Search ..... 439/638, 439/500

See application file for complete search history.

(56) References Cited

U.S. PATENT DOCUMENTS

| | | | | |
|---|---|---|---|---|
| 4,261,634 | A | 4/1981 | Robinson | |
| 4,310,874 | A | 1/1982 | Spiteri | |
| 4,936,796 | A | 6/1990 | Anderson, Jr. | |
| 5,076,805 | A | 12/1991 | Welch | |
| 5,766,020 | A * | 6/1998 | Hughes | 439/35 |
| 5,831,413 | A | 11/1998 | Gould | |
| 5,993,262 | A * | 11/1999 | Kowdynski et al. | 439/638 |
| 6,007,373 | A | 12/1999 | Chew | |
| 6,147,471 | A | 11/2000 | Hunter | |
| 6,621,724 | B1 | 9/2003 | Liu | |
| 6,841,973 | B2 | 1/2005 | Bernardon et al. | |
| 2003/0104773 | A1 * | 6/2003 | Krondorfer et al. | 451/342 |

* cited by examiner

*Primary Examiner*—James Harvey
*Assistant Examiner*—Travis Chambers
(74) *Attorney, Agent, or Firm*—Charles L. Thoeming

(57) ABSTRACT

Universal adapters for portable electronic devices, and more particularly to cellular telephones using a 0.25V-24V direct current power supply to provide battery power supply to the connected cellular telephone, particularly in an emergency case, or in case an indoor charger using alternating current or a vehicular charger is not available, or the battery of the cellular telephone is depleted and needs rapid charge.

9 Claims, 4 Drawing Sheets

UNIVERSAL BATTERY CHARGER/POWER SOURCE ADAPTER

CROSS-REFERENCES TO RELATED APPLICATIONS

This United States non-provisional patent application is based upon and claims the filing date of U.S. Provisional Patent Application Ser. No. 60/723,087, filed Oct. 3, 2005.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

Field of the Invention

The present invention relates to universal adapters for portable electronic devices, and more particularly to cellular telephones using a 0.25V-24V direct current power supply to provide power to the connected cellular telephone, particularly in an emergency case, or in case an indoor charger using alternating current or a vehicular charger is not available or the battery of the cellular telephone has run out of power and needs a rapid charge or recharge.

Portable electronic devices, particularly cellular telephones, are widely used. Electronic device users often employ a spare auxiliary battery to replace the original device battery in the event of battery discharge or failure. If an auxiliary battery is not available, the device with the discharged battery must be recharged with an exterior charger or hands-free vehicle kit charger.

In order to continuously use a portable electronic device, particularly a cellular telephone, a user should keep a charged auxiliary battery available at all times for the device. There is a tendency, however, to only use the battery integral with the device because it causes user inconvenience to carry an additional auxiliary battery.

During operation, inadequate use of the charger in recharging the battery of a portable electronic device such as cellular telephones often brings about battery discharge. Conventional chargers generally utilize an alternating current source, 110V-220V, designed for indoor or public use, it becomes difficult to recharge the battery at the outdoor place without an alternating current source. In a motor vehicle, power of 0.25V-24V direct current is utilized to recharge the battery, but this often necessitates the ignition of the vehicle's engine and requires the charger and cellular telephone to remain inside the car. In instances of national disaster, war or terrorist attack, traditional sources of recharge power are not reliable, if even present, while much or all of the communications infrastructure remains intact. During such times, cellular telephones and other portable electronic devices need alternative or additional sources of power. The present invention adequately meets this need in providing a readily portable, universal adapter for these devices to operate and recharge.

BRIEF SUMMARY OF THE INVENTION

The present invention is derived to solve the above conventional problems, and has an object to provide a handy emergency power source and battery charger for portable electrical devices, particularly cellular telephones, wherein a voltage source is held in a charger body to readily power and/or recharge the cellular telephone battery at any time regardless of location.

In order to accomplish the above objects, there is provided a handy battery charger adapter for portable electronic devices, comprising an adapter apparatus consisting of at least one conductive block sized to be attached to, engage, and communicate with an external power source having a cathode post and at least one anode post.

Thus, it is an objective of the present invention to provide an adapter for portable electronic device battery chargers which universally connect to a 0.25V-24V direct current power supply to provide reliable battery power supply to a connected cellular telephone, particularly in an emergency case, or in case an indoor charger using alternating current or a vehicular charger is not available or the battery of the cellular telephone has run down and needs a rapid charge.

It is a further objective of the present invention to provide such a universal adapter that is inexpensive, robust, and easy to use with no training in situations without light or with low light.

Yet another intended and desired feature of the present invention is to provide such a universal adapter for use in public safety emergency field operations, search and rescue operations, or evacuation procedures.

Still another intended and desired feature of the present invention is to provide such a universal adapter that is self centering for electrical contacts and locks into place with a minimum amount of effort and no understanding of electric circuitry by the operator.

It is a further purpose of the present invention to provide such a universal adapter that will allow extended duration emergency power supply for portable electronic devices.

Other features, advantages, and objects of the present invention will become apparent with reference to the following description and accompanying drawings.

BRIEF DESCRIPTION OF DRAWINGS

The accompanying drawings, which are incorporated into and form a part of the disclosure, illustrate an embodiment of the invention, and together with the description, serve to explain the principles of the invention. It should be understood that, because of the great disparity between various features depicted in the same drawing, the following drawings are not necessarily drawn to scale; it is intended that they be merely illustrative of the process.

DETAILED DESCRIPTION OF THE INVENTION

Figure 1:
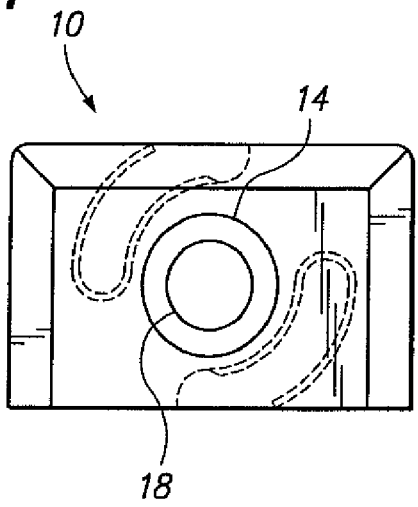
FIG. 1 is a planar top view of the apparatus 10 of an embodiment of the present invention.
Figure 2:
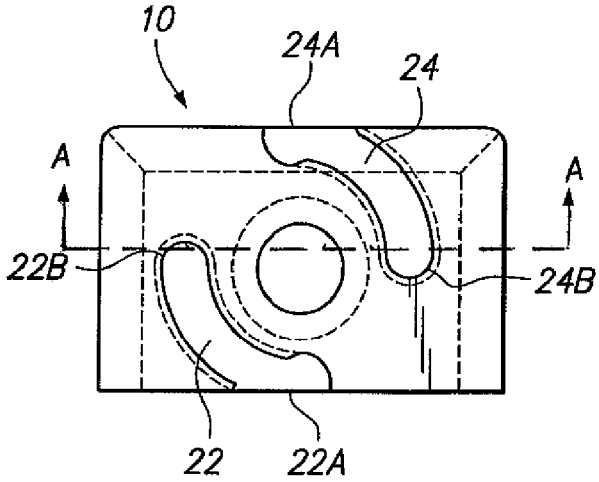
FIG. 2 is a planar bottom view of the apparatus 10 of an embodiment of the present invention.
Figure 3:
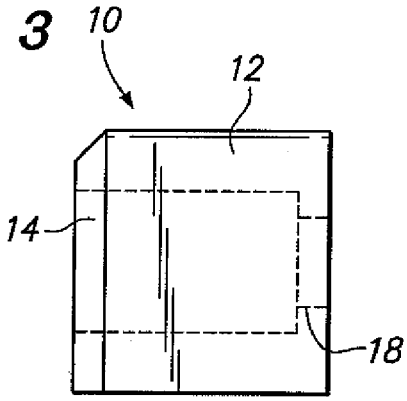
FIG. 3 is a planar side view of the apparatus 10 of an embodiment of the present invention.
Figure 4:
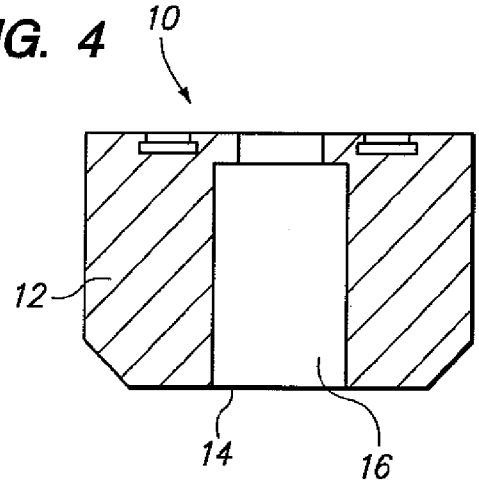
FIG. 4 is a cross sectional view of the apparatus depicted in FIG. 2 taken at "A-A."
Figure 5:
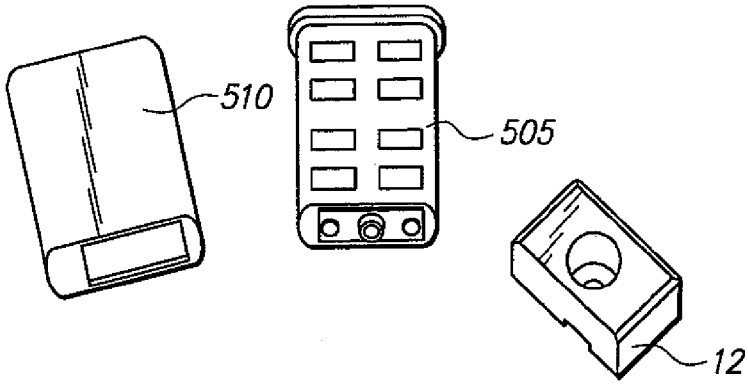
FIG. 5 is a perspective view of the conductive block 12 of an embodiment of the present invention and the power supply cover 510 and dry-cell battery pack 505 of a typical power supply 500.
Figure 6:
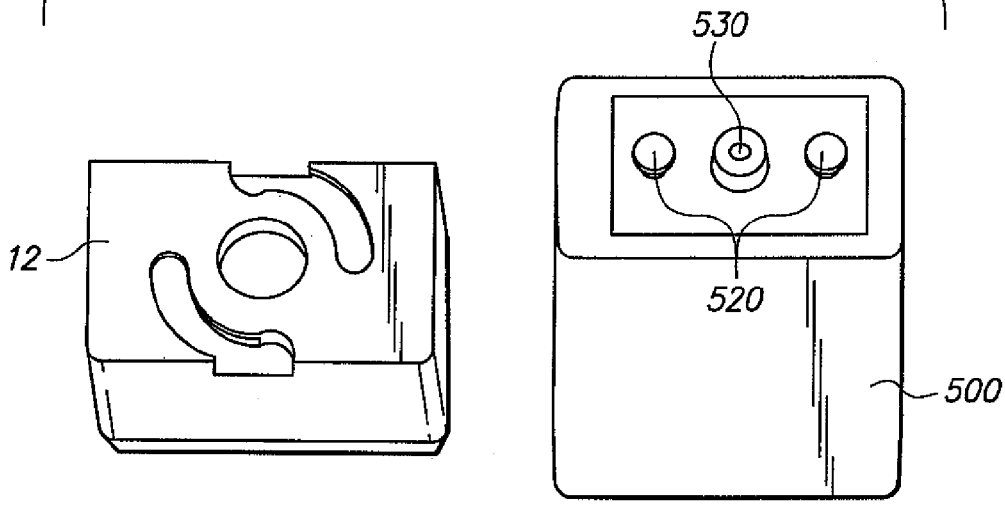
FIG. 6 is a perspective view of the bottom of the conductive block 12 of an embodiment of the present invention and the power supply cathode post 530 and anode posts 520 of a typical power supply 500.
Figure 7:
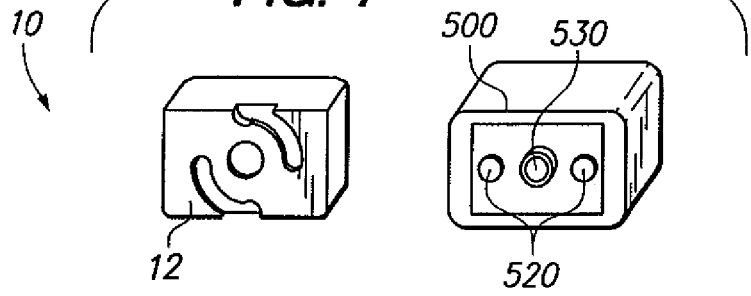
FIG. 7 is another perspective view of the bottom of the conductive block 12 of an embodiment of the present invention and the power supply cathode post 530 and anode posts 520 of a typical power supply 500.

With reference to the drawing figures, an embodiment of the present invention for universal adapter apparatus for charging and/or powering portable electronic devices provides an adapter apparatus 10 comprising at least one conductive block 12 sized to rotate upon and releasably attach to an external power source 500 having an cathode post 530 and at least one anode post 520.

The conductive block 12 comprises a top side, a bottom side, first and second latitudinal sides, and first and second longitudinal sides. The adapter further comprises alignment means whereby the external power source cathode post 530 is self centered within the conductive block after attachment thereto. The conductive block further comprises a central axis of rotation. The alignment means comprises a first annular aperture 14 and a second annular aperture 18 centered on the conductive block 12 central axis thereby defining a conductive block interior surface 16 contact point. The first annular aperture 14 has a larger diameter than the second annular aperture 18. The second annular aperture 18 is on the block bottom side.

The adapter also comprises attachment means whereby the conductive block is positioned onto at least one anode post 520 of the external power source 500. The adapter apparatus further comprises locking means whereby the conductive block 12 is locked into place on at least one anode post 520 of the external power source 500. Connecting means whereby the adapter is connected to at least one portable electronic device completes the adapter apparatus of an embodiment of the present invention.

Figure 8:
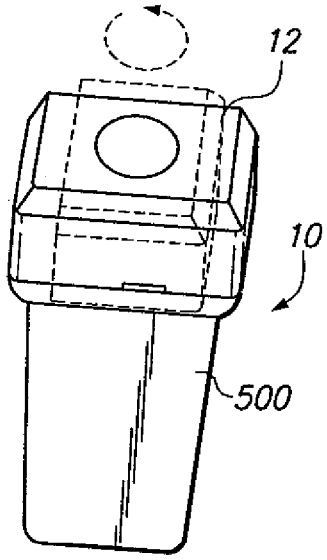
FIG. 8 is a perspective view of the conductive block 12 of an embodiment of the present invention positioned to be locked onto anode posts of a typical power supply 500.
Figure 9:
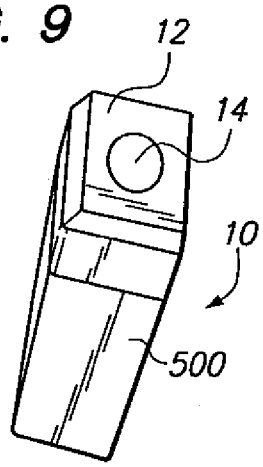
FIG. 9 is a perspective view of the conductive block 12 of an embodiment of the present invention positioned and locked onto cathode posts of a typical power supply 500 whereby the block is aligned with the power supply 500 body.
Figure 10:
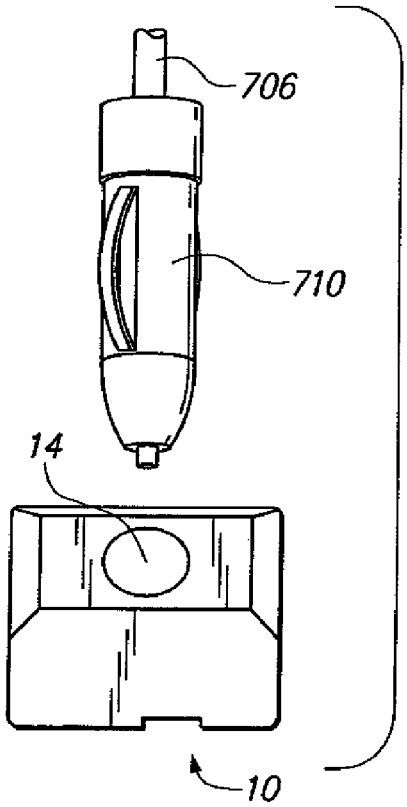
FIG. 10 is a perspective view of the apparatus 10 of an embodiment of the present invention positioned to receive a connecting means 700 plug end 710 into first annular aperture 14.
Figure 11:
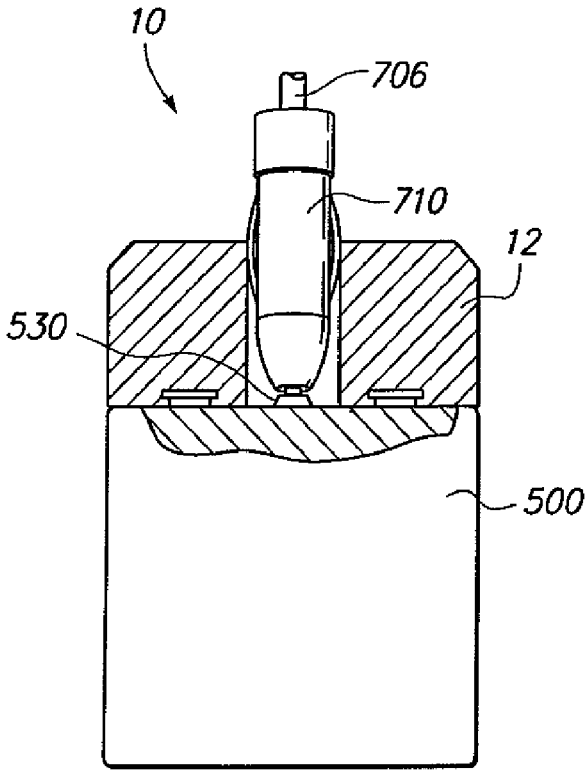
FIG. 11 is a partial cut-away view of the conductive block 12 of an embodiment of the apparatus 10 of the present invention positioned to receive a connecting means 700 plug end 710 with cable 706 attached into the conductive block 12 first annular aperture 14 whereby the plug end communicates with the power supply cathode post 530 through the second annular aperture 18.

The attachment means and locking means comprise two arcuate channels, 22 and 24, of equal length on the block bottom side, each channel having a first and second end. Each channel is sized to engage and receive one anode post. One channel has an open first end 22A flush with one block longitudinal side. The other channel has an open first end 24A flush with the other block longitudinal side. Each channel has closed second ends, 22B and 24B, defining a diameter sufficient to receive and lock onto a anode post 520 as an anode contact point. Both closed channel second end contact points communicate with the conductive block interior surface anode contact point. In this manner, the anode posts 520 are positioned at the channel open first ends and received and locked into the channel closed second ends by rotation of the conductive block 12 about the conducive block central axis, FIG. 8, onto a locking position on the power supply 500. The positioned and locked conductive block 12 as disclosed is aligned with the power supply 500 body, FIG. 9.

The connecting means comprises a cable 706 with a plug end 710 comprising a central cathode contact and periphery anode contacts and an adapter end. The conductive block first annular aperture 14 is sized to receive and engage the plug end 710 and align the plug end central cathode contact with the external power source cathode 530 so that these parts contact. The plug end 710 central cathode communicates with the external power source cathode 530 through the conductive block second annular aperture 18. The periphery plug end 710 anode contacts communicate with the conductive block interior surface 16 contact point once the block has been locked onto the anode posts 520 of the external power source 500, and the plug end has been inserted into the first annular aperture 14. The plug end 710 central anode contact is insulated from the periphery cathode contacts.

The external power supply 500 source comprises a direct current source 505, housed within a cover 510. Power supply battery cell voltage combined with embodiments of the present invention can be scaled to deliver from 0.25 volts to 24 volts for extended use or charge time. Most portable electronic devices employ a control circuit incorporated in the device. This control circuit only begins to charge the device's rechargeable battery or operate the device if the voltage from the emergency charge apparatus is above a pre-set lower threshold. Many portable electronic devices, such as cellular telephones, set this lower threshold at 3.6 volts. Other devices set the control circuit limit higher, at about 9 volts. Voltage in excess of the electronic device's control circuit lower threshold can operate the device while the device's battery is being recharged. Thus, a 0.25 volt-24 volt range of power supply battery cell voltage when attached to embodiments of the present invention will simultaneously operate and re-charge the device battery for most portable electronic devices presently sold.

In yet another embodiment of the present invention, the conductive block further comprises non-conductive exterior surfaces including, but not limited to, materials selected from the group consisting of wood, epoxy, resin, acrylic, plastic composites, cellulose, laminates including metal laminates, painted or injection molded (filled) materials, polycarbonate, and polystyrene.

All contact points within the conductive block (22B, 24B, and 16) are constructed from any suitable conductive metal including, but not limited to, materials selected from the group consisting of silver, aluminum, copper, and steel alloy. The preferred embodiment of the present invention comprises contact points within the conductive block (22B, 24B, and 16) made of aluminum.

As to the manner of usage and operation of the adapter, and the means of electrical power necessary to drive the present invention, the same should be apparent from the above description and the art. Accordingly, no further discussion relating to the manner of usage, operation, or direct current means to power the present invention will be provided.

Although the invention has been described in some detail with reference to the preferred embodiment and alternatives, those of skill in the art will realize, in light of the teachings herein, that certain changes and modifications can be made without departing from the spirit and scope of the invention. Accordingly, the invention is limited only by the claims of any subsequent United States non-provisional or foreign patent application.

We claim:

1. A universal adapter apparatus for connecting portable electronic devices to a direct current external power source comprising an anode post and at least one cathode post, the adapter apparatus comprising:

a block sized to be attached to the external power source, the block comprising a central axis, a bottom side, first and second longitudinal sides, and non-conductive exterior surfaces;

two arcuate channels of equal length on the block bottom side, each channel having a first and second end, wherein each channel is sized to engage and receive one cathode post, wherein one channel has an open first end flush with one block longitudinal side and the other channel has an open first end flush with one block longitudinal side, whereby the anode posts are positioned at the channel open first ends and received into the respective channel by rotation of the block about the central axis thereby positioning the block onto at least one anode post of the external power source;

closed channel conductive second ends defining a diameter sufficient to receive and lock onto a anode post by rotation of the conductive block about the central axis thereby locking the block into place on at least one anode post of the external power source;

a first conductive annular aperture centered on the block central axis defining a block conductive interior surface in communication with the closed channel conductive second ends;

a second annular aperture centered on the block central axis bottom side having a diameter smaller than the first annular aperture serving to self center the external power source cathode post within the conductive block after attaching and locking the block to the power source; and a cable with a plug end having a central cathode contact and periphery anode contacts and an adapter end, wherein the first annular aperture is sized to receive and engage the plug end and align the plug end central cathode contact with the external power source cathode within the second annular aperture and the periphery anode contacts communicate with the block interior surface once the block is positioned and locked onto the anode posts of the external power source, and whereby the adapter is connected to at least one portable electronic device.

2. The apparatus of claim 1, wherein conductive elements comprise any conductive material.

3. The apparatus of claim 1, wherein the block comprises any nonconductive material.

4. A universal adapter apparatus for connecting portable electronic devices to a direct current external power source comprising an anode post and at least one cathode post, the adapter apparatus comprising:

an aluminum block sized to be attached to the external power source, the aluminum block comprising a central axis, a bottom side, first and second longitudinal sides, and non-conductive exterior surfaces;

two arcuate channels of equal length on the aluminum block bottom side, each channel having a first and second end, wherein each channel is sized to engage and receive one anode post, wherein one channel has an open first end flush with the first aluminum block longitudinal side and the other channel has an open first end flush with the second aluminum block longitudinal side, whereby the anode posts are positioned at the channel open first ends and received into the respective channel by rotation of the aluminum block about the central axis thereby positioning the aluminum block onto at least one anode post of the external power source;

closed channel second ends defining a diameter sufficient to receive and lock onto an anode post by rotation of the aluminum block about the central axis thereby locking the aluminum block into place on at least one anode post of the external power source;

first and second annular apertures of different diameters centered on the aluminum block central axis wherein the first annular aperture defines an aluminum block interior surface in communication with the closed channel conductive second ends and the second annular aperture serves to self center the external power source cathode post within the aluminum block bottom side after attaching and locking the block to the power source; and a cable with a plug end having a central cathode contact and periphery anode contacts and an adapter end, wherein the first annular aperture is sized to receive and engage the plug end and align the plug end central cathode contact with the external power source cathode within the second annular aperture and the periphery anode contacts communicate with the aluminum block interior surface once the aluminum block is positioned and locked onto the anode posts of the external power source, and whereby the adapter is connected to at least one portable electronic device.

5. A universal adapter apparatus for connecting portable electronic devices to a direct current external power source comprising an anode post and at least one cathode post, the adapter apparatus comprising:

a conductive block sized to be attached to the external power source, the conductive block comprising a central axis, a bottom side, first and second longitudinal sides, and non-conductive exterior surfaces;

attachment means to position the conductive block onto at least one anode post of the external power source, the attachment means comprising two arcuate channels of equal length on the conductive block bottom side, each channel having a first and second end, wherein each channel is sized to engage and receive one anode post, wherein one channel has an open first end flush with one block longitudinal side and the other channel has an open first end flush with one block longitudinal side, whereby the anode posts are positioned at the channel open first ends and received into the respective channel by rotation of the conductive block about the central axis;

locking means to lock the conductive block into place on at least one anode post of the external power source;

alignment means to define a conductive block interior surface whereby the external power source cathode post is self centered within the conductive block after the block is attached and lock onto the power source; and connecting means to connect the adapter to at least one portable electronic device.

6. The apparatus of claim 5, wherein locking means comprises closed channel second ends defining a diameter sufficient to receive and lock onto a anode post by rotation of the conductive block about the central axis.

7. The apparatus of claim 5, wherein alignment means comprises first and second annular apertures centered on the conductive block central axis, wherein the first annular aperture has a larger diameter than the second annular aperture and the second annular aperture is on the bottom side.

8. The apparatus of claim 7, wherein connecting means comprises a cable with a plug end having a central cathode contact and periphery anode contacts and an adapter end, wherein the first annular aperture is sized to receive and engage the plug end and align the plug end central cathode contact with the external power source cathode within the second annular aperture and the periphery anode contacts communicate with the block interior surface once the conductive block is positioned and locked onto the anode posts.

9. The apparatus of claim 5, wherein the conductive block comprises any conductive material.

* * * * *